US006814012B2

(12) United States Patent
McCaffrey et al.

(10) Patent No.: US 6,814,012 B2
(45) Date of Patent: Nov. 9, 2004

(54) FURNACE BINDING AND ADJUSTMENT SYSTEMS

(75) Inventors: Felim P. McCaffrey, Toronto (CA); Keith E. Joiner, Guelph (CA); Robert J. Veenstra, Thamesford (CA)

(73) Assignee: Hatch Associates Ltd., Mississauga (CA)

( * ) Notice: Subject to any disclaimer, the term of this patent is extended or adjusted under 35 U.S.C. 154(b) by 0 days.

(21) Appl. No.: 10/269,392

(22) Filed: Oct. 11, 2002

(65) Prior Publication Data

US 2004/0069192 A1 Apr. 15, 2004

(51) Int. Cl.[7] ..... F23M 5/00
(52) U.S. Cl. ..... 110/337; 266/285
(58) Field of Search ..... 266/900, 901, 266/285, 280, 286; 264/228; 110/336; 52/249

(56) References Cited

U.S. PATENT DOCUMENTS

| | | | | |
|---|---|---|---|---|
| 2,622,433 A | * | 12/1952 | Jones | 72/101 |
| 2,656,717 A | * | 10/1953 | Fourmanoit | 73/88 |
| 2,853,440 A | | 9/1958 | Hughes | |
| 2,975,499 A | * | 3/1961 | Lapp | 25/142 |
| 3,175,961 A | | 3/1965 | Olsen | |
| 3,197,385 A | | 7/1965 | Wethly | |
| 3,203,376 A | | 8/1965 | Engelhardt | |
| 3,295,280 A | * | 1/1967 | Kettner | 52/378 |
| 3,682,457 A | | 8/1972 | Hollingsworth | |
| 3,805,466 A | * | 4/1974 | Van Laar et al. | 52/249 |
| 4,240,234 A | | 12/1980 | Eisinger et al. | |
| 4,432,289 A | * | 2/1984 | Norman et al. | 110/336 |
| 4,469,312 A | * | 9/1984 | Konda et al. | 266/99 |
| 4,732,652 A | | 3/1988 | Dürselen et al. | |
| 4,773,630 A | * | 9/1988 | Carminati et al. | 266/285 |
| 6,286,442 B1 | | 9/2001 | Ranki | |

OTHER PUBLICATIONS

R. C. Franchi, et al., Non–Ferrous Pyrometallurgy, "Design Of Refactories And Bindings For Modem High–Productivity Pyrometallurgical Furnaces," CIM Bulletin, Jun., 1993, vol. 86, No. 971, pp. 112–118.

* cited by examiner

*Primary Examiner*—Kenneth Rinehart
(74) *Attorney, Agent, or Firm*—Marshall, Gerstein & Borun LLP

(57) ABSTRACT

A furnace binding and adjustment system for maintaining a refractory furnace hearth under compression utilizes a plurality of buckstays connected at their upper and lower ends by tie members. A fluid-pressurized tensioning device, preferably a hydraulics device, is provided at the ends of at least some of the tie members to permit some relative movement between the tie member end and the buckstay to permit adjustment of compressive forces applied to the refractory hearth. The use of multiple hydraulic devices permits simultaneous activation of the tensioning devices, and also permits the hydraulic pressure in the cylinders to be accurately adjusted and monitored from a remote location.

19 Claims, 10 Drawing Sheets

FURNACE BINDING AND ADJUSTMENT SYSTEMS

FIELD OF THE INVENTION

The present invention relates to furnaces constructed of hearth and sidewall refractories, and more particularly relates to systems for the compressive binding of these refractories.

BACKGROUND OF THE INVENTION

Furnaces are used extensively in the smelting and converting of ferrous and non-ferrous ores and concentrates. Furnaces of this type are generally circular or rectangular, having a bottom wall (hearth) and vertical walls comprised of refractory bricks and a roof or off gas hood. These furnaces are also characterized by a binding and support structure, the purpose of which is to maintain the refractory bricks of the hearth and walls in compression.

Adequate compression of the furnace walls, and particularly the hearth, is critical to maximize furnace campaign life and to prevent costly and potentially catastrophic furnace failure. During heating of the furnace to operating temperature, the individual bricks comprising the hearth and the walls expand, resulting in outward expansion of the hearth. Conversely, cooling of the furnace results in contraction of the individual bricks and overall shrinking of the furnace. If the compressive forces on the hearth or the walls are insufficient, gaps will be formed between the bricks during cooling phases of the furnace operation. These gaps can be infiltrated with molten metal or other material, resulting in permanent growth of the furnace. Repetition of heating and cooling cycles results in further incremental expansion of the furnace (known as "ratcheting"), which usually results in a reduction of the furnace campaign life, by the potential for molten infiltration into the hearth refractory or excessive expansive forces exerted on the binding system.

In rectangular furnaces, the binding system usually consists of regularly spaced vertical beams known as "buckstays", which are held together at the top and bottom by horizontal tie members extending across the furnace, the bottom tie members passing beneath the hearth and the upper tie members passing above the furnace roof. The structure of electric furnaces is discussed in more detail in Francki et al., Design of refractories and bindings for modem high-productivity pyrometallurgical furnaces, Non-Ferrous Metallurgy, Vol. 86, No. 971, pp. 112 to 118. Frequent adjustment of the tie members, as by loosening or tightening retaining nuts at the tie member ends, is necessary to maintain relatively constant compression on the refractories during thermal cycling of the furnace. The binding systems of most large rectangular furnaces in operation today are equipped with compression spring sets sized to maintain the desired compression on the brick work, thereby permitting some expansion and contraction of the furnace while maintaining the hearth under compression.

While spring sets permit some furnace movement, they do not eliminate the need for periodic adjustment of the spring loads to ensure that the forces on the tie members and the furnace hearth remain relatively constant during use of the furnace. Adjustment of the spring loads is performed with hydraulic jacking equipment, and is a difficult and unpleasant operation due the fact that the vicinity of the furnace is usually hot, dirty and ill-lit and because the adjustment screws on the spring sets usually become more difficult to turn with time. Therefore, the frequency of adjustment tends to be low and spring binding systems are often not used to their full advantage.

The problems with prior art adjustment systems are exemplified by U.S. Pat. No. 3,197,385 (Wethly), issued on Jul. 27, 1965. This patent relates to the use of hydraulic jacking equipment for adjustment of tie rod tension in a coke oven battery. According to Wethly, the tension in each tie rod is adjusted by a hydraulic tensioning jack which is mounted on the ends of the rods. However, the tensioning jack must be sequentially mounted on each tension rod to adjust the tension in the rods one by one, in sequence. In the sequential adjustment system taught by Wethly, it would be difficult to control the tension in the rods with any degree of precision since adjusting the tension in one rod will have an effect on the tension in neighboring rods. Furthermore, the sequential mounting and use of a hydraulic jack in close proximity to the furnace is an unpleasant task which is likely to be performed only when absolutely necessary, and therefore the frequency of adjustment is likely to be low.

Therefore, a need exists for improved furnace binding systems for both rectangular and circular furnaces. Preferably, such systems would permit the compressive forces on the refractory hearth and furnace walls to be accurately adjusted, and would permit adjustment of the compressive forces to be carried out remotely and continuously, thereby maximizing furnace life and improving safety.

SUMMARY OF THE INVENTION

The present invention overcomes the above-described problems of the prior art by providing a furnace binding and adjustment system in which the compressive forces on the furnace hearth can be accurately controlled and monitored on a continuous basis. The system of the invention includes fluid-pressurized tensioning or compression means for maintaining compressive forces on the hearth and/or furnace walls. The compressive forces applied to the furnace by the binding system are regulated by one or more pressure regulation means adapted to simultaneously or individually adjust the fluid pressure in one or more of the tensioning or compression means, thereby overcoming the problems in the prior art.

The control of the tensioning or compression means by one or more pressure regulation means is particularly well suited to remote operation, whereby a furnace operator situated in a control room can regulate the pressure in the pressure regulation means, thereby eliminating the need to carry out manual adjustments in the vicinity of the furnace. Furthermore, since the fluid pressure in the pressure regulation means and in the tensioning or compression means is proportional to the compressive forces exerted on the furnace, the binding system of the present invention permits accurate measurement and control of the compressive forces exerted on the furnace.

BRIEF DESCRIPTION OF THE DRAWINGS

The invention will now be described, by way of example only, with reference to the accompanying drawings, in which.

DETAILED DESCRIPTION OF PREFERRED EMBODIMENTS

A first preferred furnace binding and adjustment system, adapted for maintaining compression on a refractory furnace hearth of a rectangular furnace, is now described below with reference to FIGS. 1 to 10.

Figure 1:
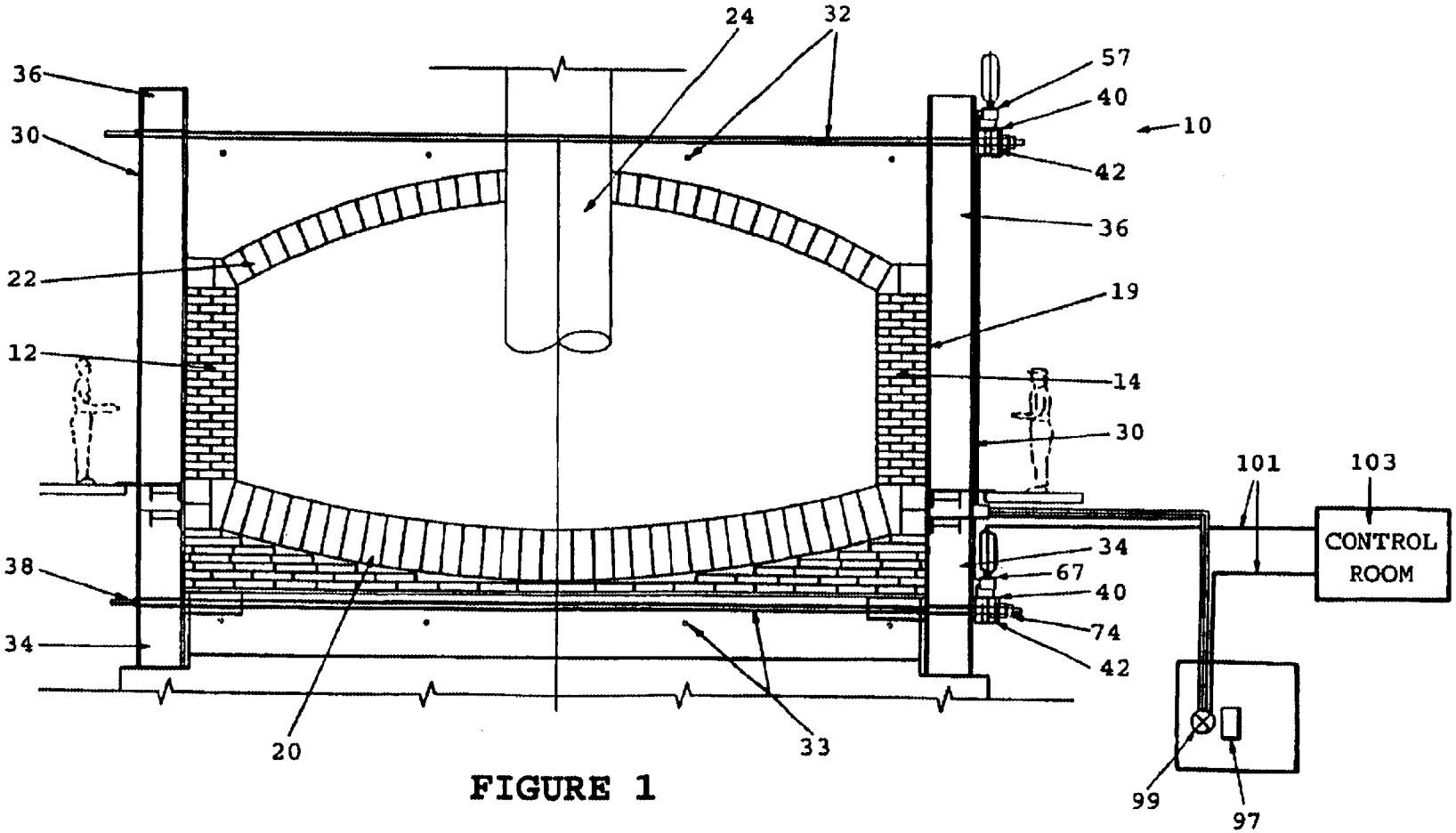
FIG. 1 is an end view, partly in cross-section, of an electric furnace incorporating a furnace binding and adjustment system according to a first preferred embodiment of the present invention.
Figure 2:
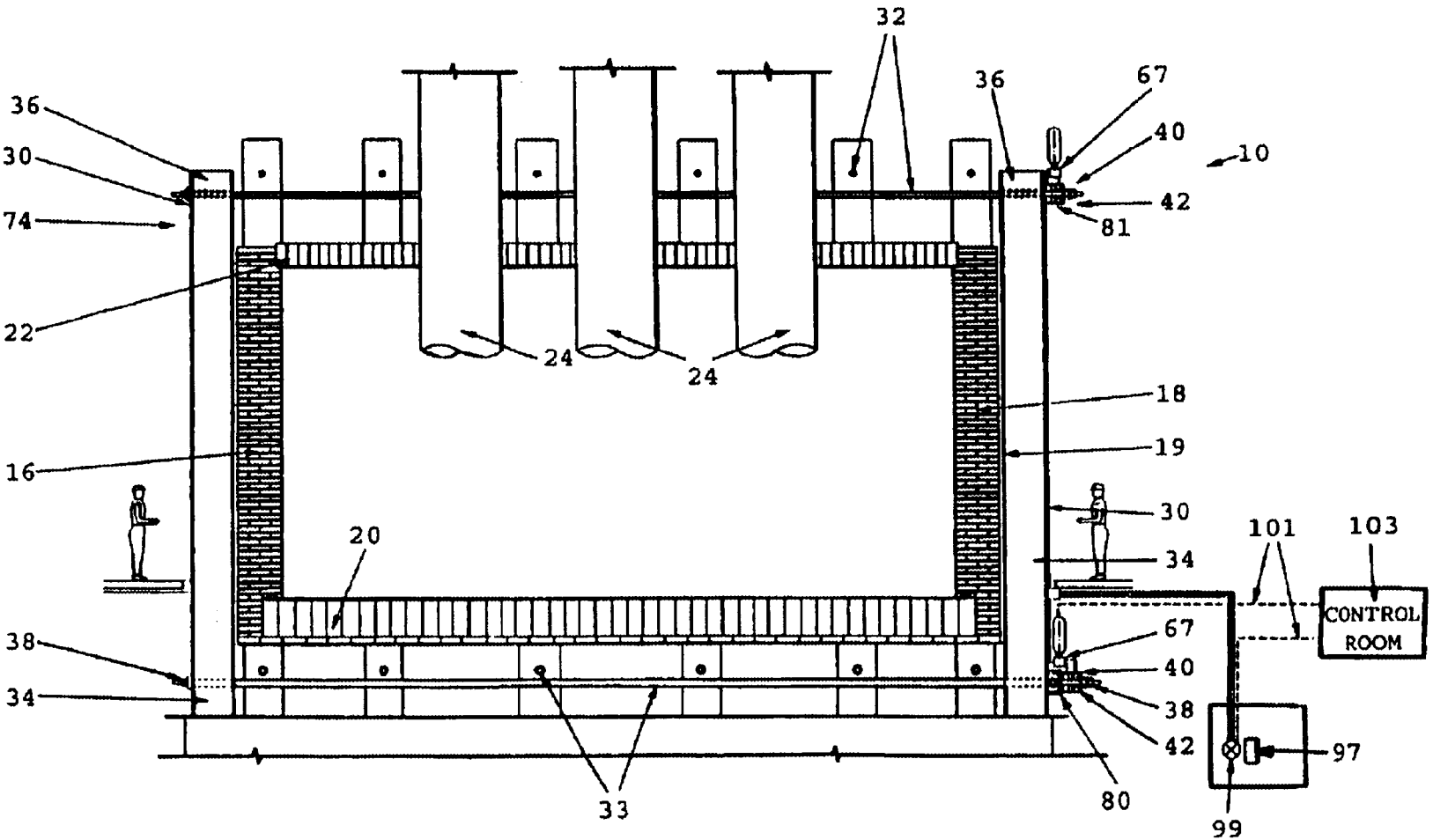
FIG. 2 is a side view, partly in cross-section, of the furnace shown in FIG. 1.

FIG. 1 illustrates the basic structure of a typical rectangular electric furnace 10 to which the system of the present invention is applied. The cross-section of FIG. 1 is taken transverse to the longitudinal axis of the furnace. Furnace 10 comprises a pair of opposed sidewalls 12 and 14, a pair of opposed end walls 16 and 18 (FIG. 2), a hearth 20, an arched roof 22, and a plurality of electrodes 24 spaced along the longitudinal axis of the furnace 10.

The hearth 20, as well as the sidewalls 12, 14 and end walls 16, 18 are constructed of refractory brick in a known manner. The refractory bricks of the hearth and the side and end walls are maintained in compression by vertical metal shell plates 19 which are contained by flexible bindings comprised of regularly-spaced vertical buckstays 30 held together at the top and bottom by horizontal tie members 32, 33.

Figure 3:
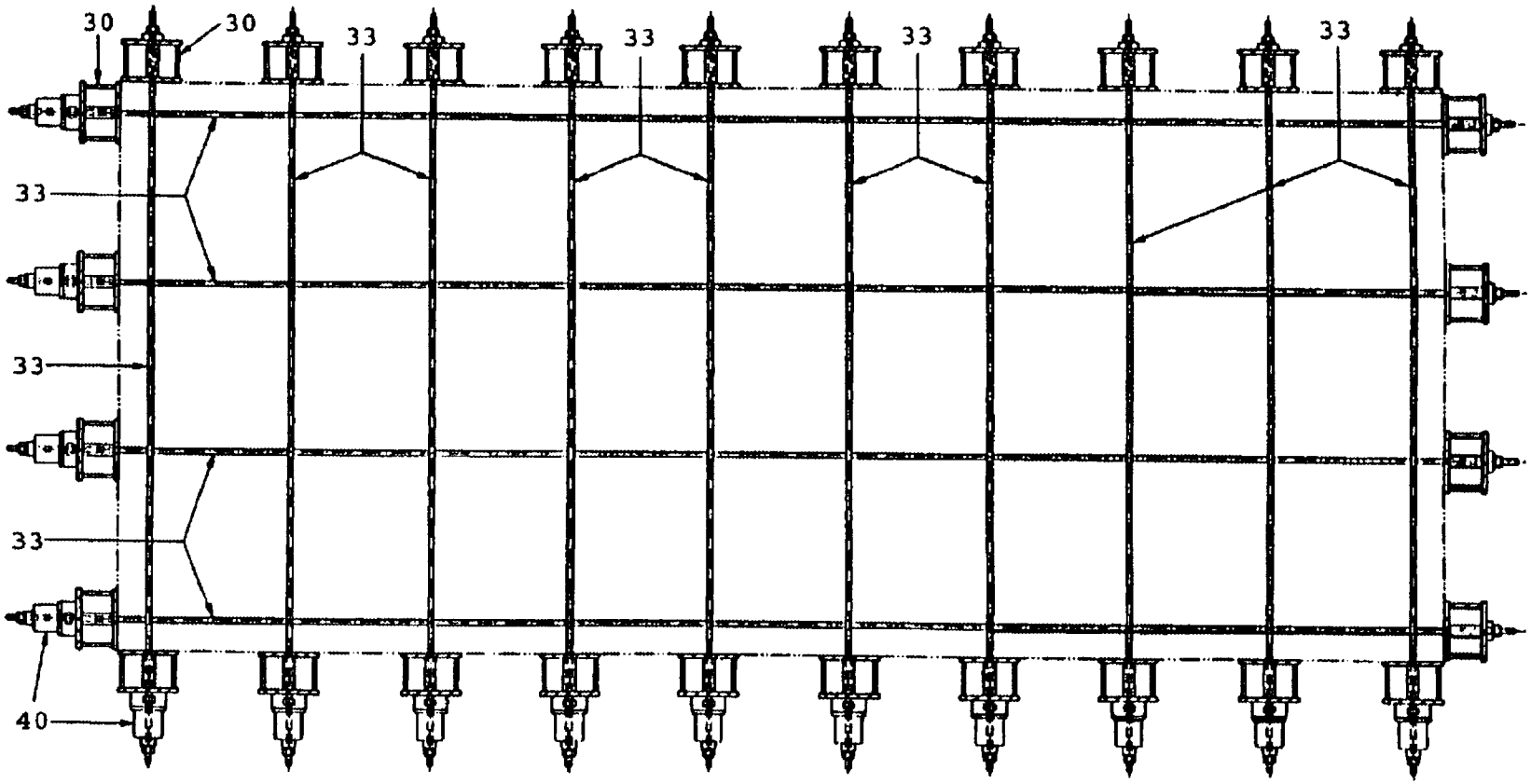
FIG. 3 is a plan view, showing in isolation the buckstays, tie members and fluid-pressurized tensioning means in the lower portion of the furnace shown in FIG. 1.

As best shown in FIG. 3, the buckstays 30 are arranged in regular, spaced relation around the side and end walls of the furnace 10. Each buckstay comprises a vertical steel beam having a lower end 34 extending below the hearth 20 and the furnace bottom and an upper end 36 extending above the tops of the furnace walls 12, 14, 16, 18 and the furnace roof 22.

The buckstays 30 are arranged in pairs, with the buckstays of each pair being positioned on opposite sides of the furnace. In FIG. 3, the buckstays of each pair are in opposed relation to one another directly across the furnace from one another.

The buckstays 30 of each pair are connected at their upper ends 36 by at least one upper tie member 32 and at their lower ends 34 by at least one lower tie member 33. In the preferred embodiment shown in the drawings, the upper ends 36 of each pair of buckstays 30 are connected by a single upper tie member 32, and the lower ends 34 of each pair of buckstays 30 are connected by a single lower tie member 33. It will be appreciated that the expansive forces are greatest at the lower ends 34 of buckstays 30 due to expansion of the hearth 20, and therefore it may be preferred to connect the lower ends 34 of each pair of buckstays 30 with two or more lower tie members 33.

As shown throughout the drawings, the upper ends 36 and lower ends 34 of buckstays 30 are apertured to permit the ends of the tie members 32, 33 to extend therethrough. The furnace binding and adjustment system further comprises a plurality of fluid-pressurized tensioning means 40 provided at the ends of tie members 32, 33, the tensioning means 40 being adjustable so as to permit lateral expansion and contraction of the furnace 10 while applying compressive forces to the hearth, sidewall and end wall refractories through the buckstays 30.

At the lower ends of buckstays 30, shown in FIG. 3, a tensioning means 40 is preferably provided at a first end of each lower tie member 33.

Similarly, a plurality of tensioning means 40 are provided at the ends of the upper tie members 32. However, the tie members 32 extending across the central portions of the side walls 12, 14 are preferably not provided with tensioning means 40 as there is relatively little lateral expansion of the furnace 10 at these points. Since the end walls 16, 18 are shorter than side walls 12, 14, each upper tie member 32 extending between the end walls 16, 18 may preferably be provided with a tensioning means at one of its ends.

Several different types of tensioning means can be employed in the system of the invention, of which two types are described herein. The tensioning means 40 preferably comprises a fluid-pressurized device for applying tension to the tie members. In the first preferred embodiment illustrated in FIGS. 1 to 8, each tensioning device includes a hydraulic cylinder 42 having a bore through which the first end of a tie member 32 or 33 extends.

Figure 8:
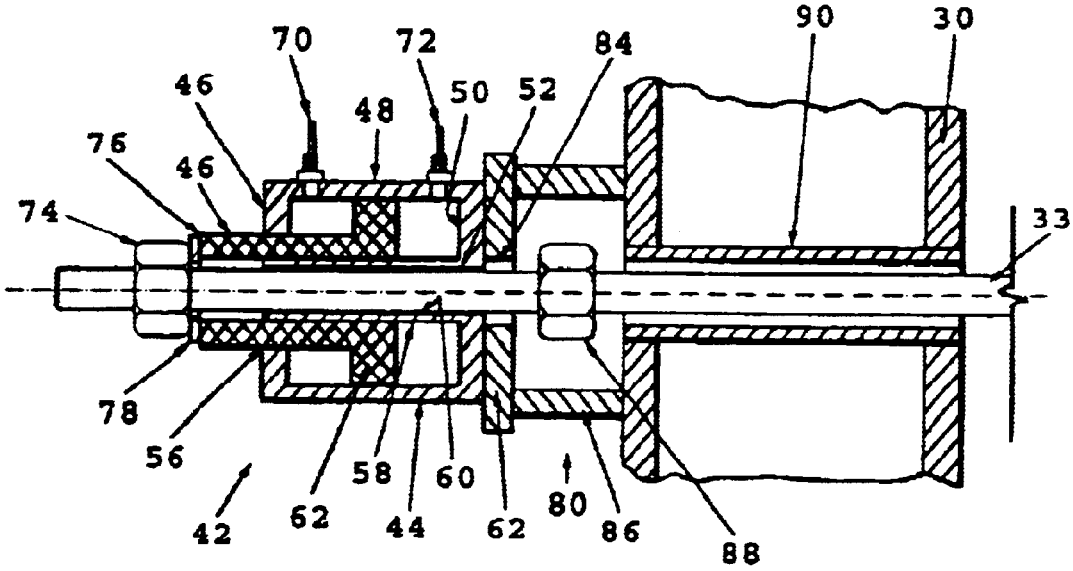
FIG. 8 is a partial cross-section through the tensioning means of FIG. 4.

Specifically referring to FIG. 8, hydraulic cylinder 42 comprises a cylindrical housing 44 enclosing a piston 46, the housing 44 having a cylindrical side wall 48, a rear wall 50 with a central aperture 52 sized to receive the tie member 33, and a front wall 54 having an aperture 56 sized to receive the piston 46. The aperture 52 is surrounded by a sleeve 58 extending through the housing 44 from rear wall 50 to front wall 54, the sleeve 58 forming a bore 60 through which the tie member 33 extends.

The piston 46 has a rear portion comprising a flange 62 which forms a seal with the side wall 48 of housing 44, thereby dividing housing 44 into a pair of chambers 64, 66, which communicate with a manifold 68 (FIGS. 4 and 5) through respective hydraulic fluid lines 70 and 72.

The first end of tie member 33 is retained by a retaining nut 74 which is threaded onto the end of tie member 33 (threads omitted for clarity), the nut 74 engaging the end face 76 of piston 46, and preferably spaced therefrom by a washer 78.

As shown in the drawings, the tie members 32, 33 extend through pipes 90 which are welded through the buckstays.

Figure 4:
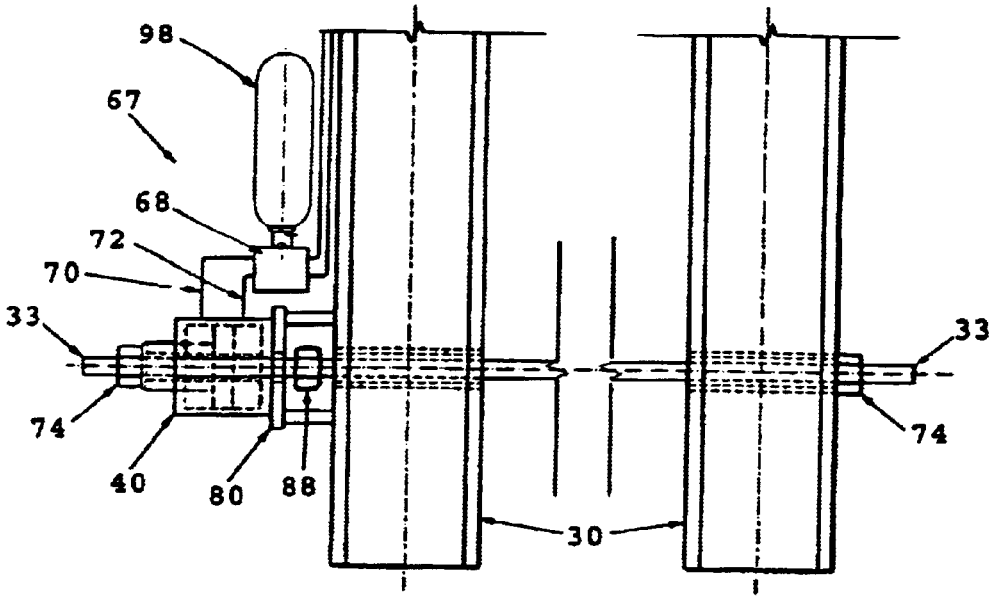
FIG. 4 is a side view showing in isolation a pair of opposed buckstays with a tie member and a fluid-pressurized tensioning means as shown in FIG. 3.
Figure 5:
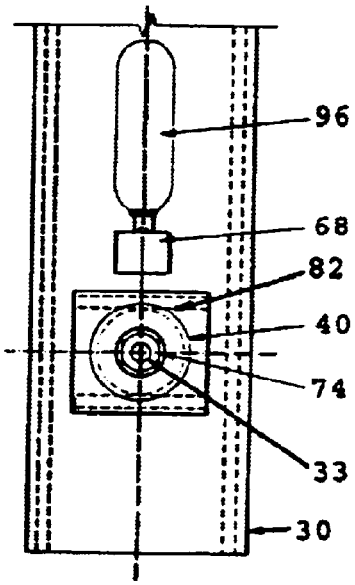
FIG. 5 is a front view of the left buckstay in FIG. 4, showing the fluid-pressurized tensioning means.
Figure 6:
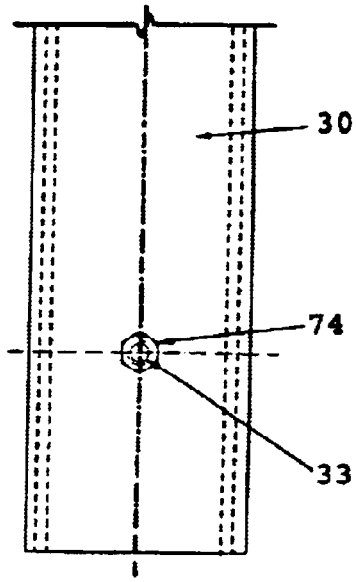
FIG. 6 is a front view of the right buckstay of FIG. 4, showing the retaining nut on the tie member end.
Figure 7:
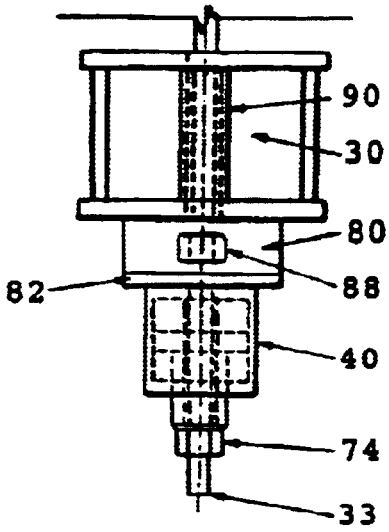
FIG. 7 is an enlarged plan view showing one of the fluid-pressurized tensioning means of FIG. 3 in the lower portion of the furnace, together with its associated buckstay and tie member ends.

The second end of tie member 33 passing through the buckstay 30 on the opposite side of the furnace is retained by a retaining nut 74 (FIGS. 4 and 6).

As mentioned above, the fluid pressure in the tensioning means 40 is regulated by pressure regulation means, generally identified by reference numeral 67 in the drawings. In the preferred embodiment of the invention, pressure regulation means 67 are provided at each of the tensioning means 40, thereby permitting the fluid pressure of the tensioning means 40 to be regulated simultaneously or individually. The pressure regulation means comprises manifold 68, already mentioned above, which communicates with the two chambers 64, 66 of hydraulic cylinder 42 through hydraulic fluid lines 70, 72. The manifold 68 controls the fluid pressure inside hydraulic cylinder 42, and therefore controls the amount of tension in the tie members 32, 33. Preferably, each pressure regulation means 67 further comprises a gas over fluid accumulator 98 (FIGS. 4 and 5) which acts to minimize changes in pressure due to changes in the forces exerted on the buckstays by the refractories.

The pressure regulation means 67 further comprises a supply of fluid and pumping means for pumping the fluid to the tensioning means 40. In the preferred embodiments of the invention, the fluid supply comprises a hydraulic fluid reservoir 97 and a pump 99 for pumping hydraulic fluid between the reservoir 97 and the manifold 68. Reservoir 97, pump 99 and the lines through which they are connected to the tensioning means are schematically shown in FIG. 1.

The system according to the invention further comprises control means for controlling operation of the pressure regulation means. Control means are generally indicated by reference numeral 101 and schematically shown in FIG. 1 as the means by which operation of the pump 99 and the manifold 68 are controlled. As shown, control means 101 are operated from a control room 103, schematically shown in FIG. 1, which is preferably remotely located relative to the furnace 10.

Figure 9:
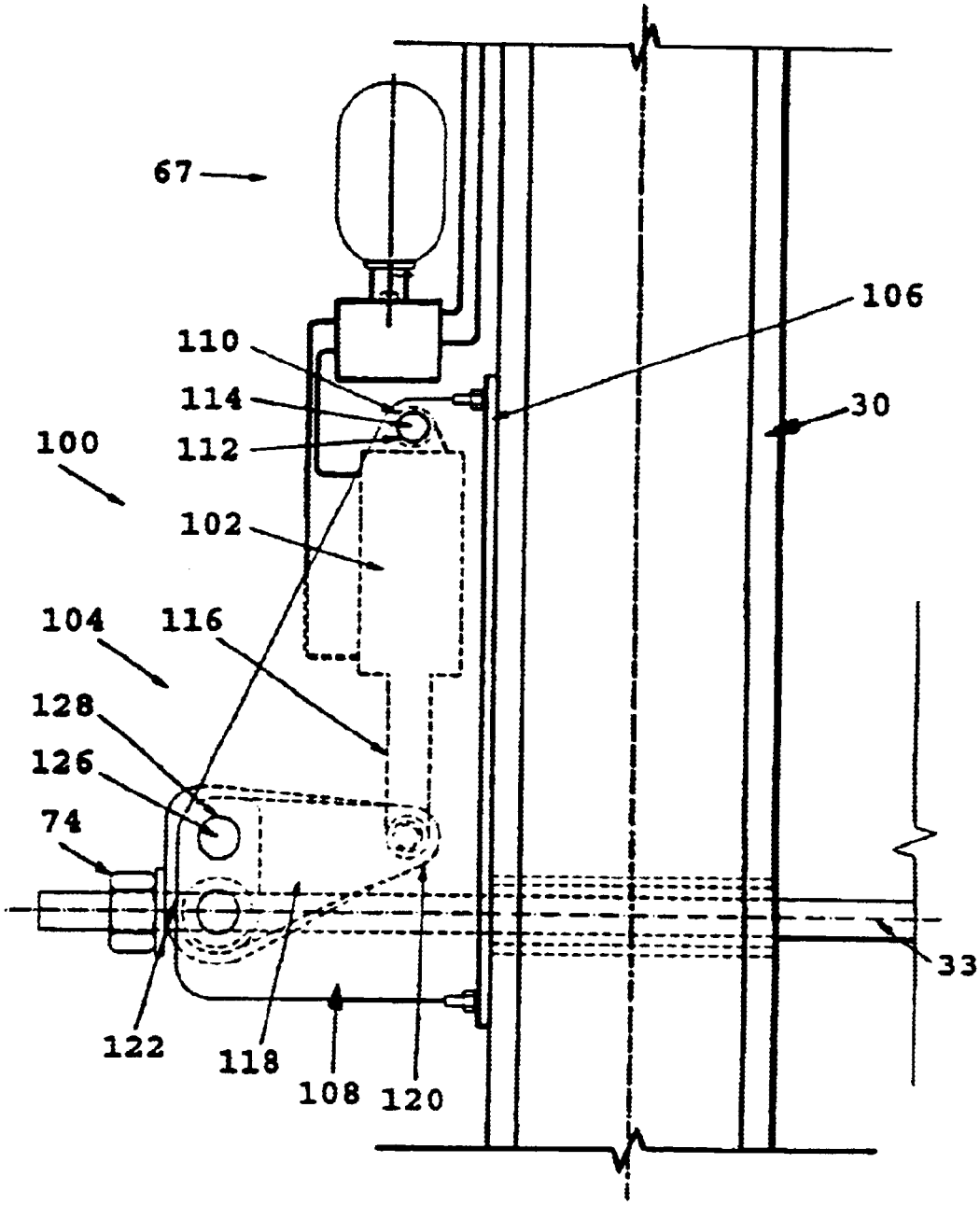
FIG. 9 is a side view of a second preferred fluid-pressurized tensioning means for use in the binding and adjustment system of the invention, the tensioning means being shown with its associated buckstay and tie member end.
Figure 10:
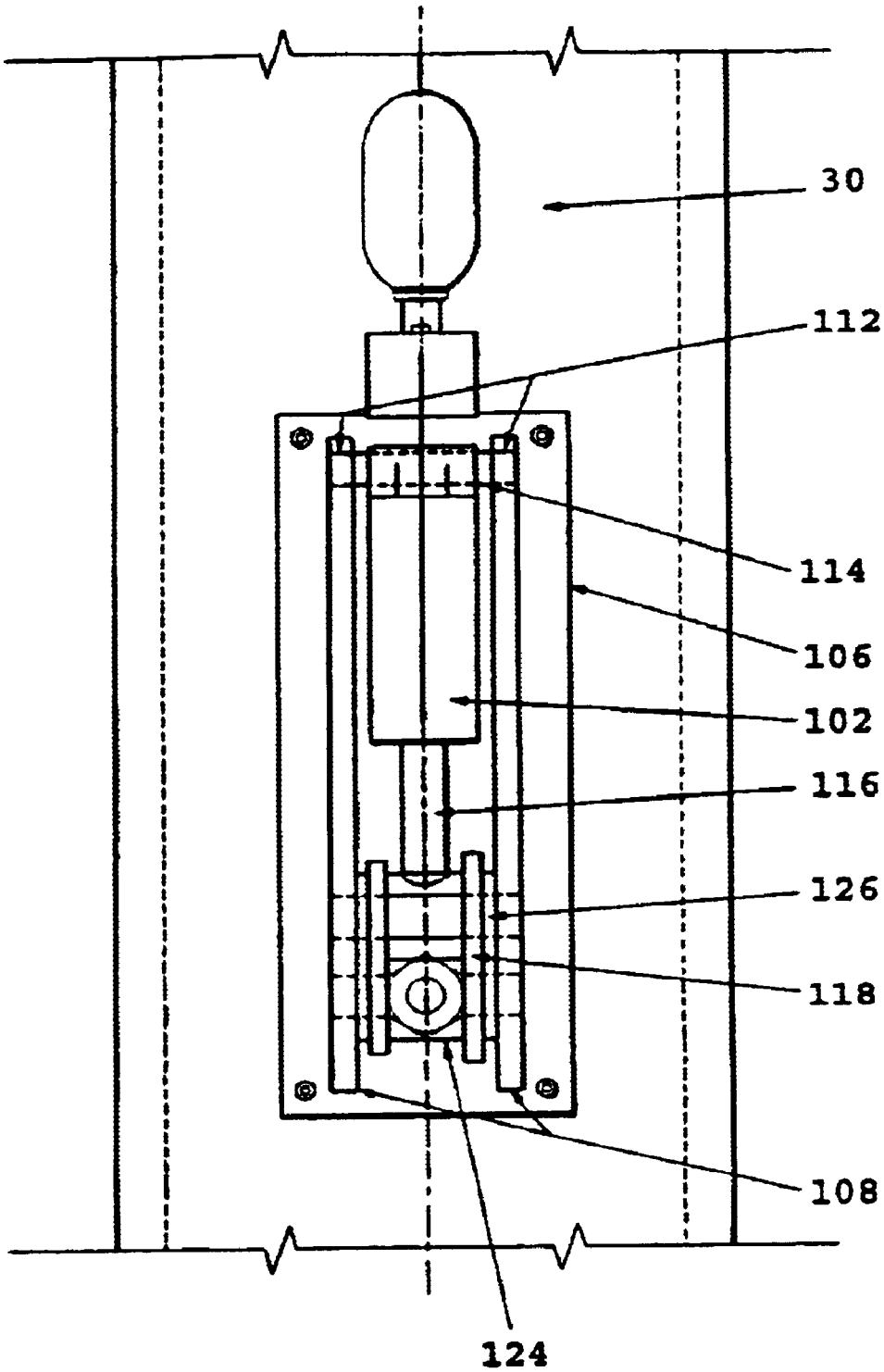
FIG. 10 is a front view of the fluid-pressurized tensioning means of FIG. 9.

A second preferred tensioning means 100 for use in the first embodiment of the invention is illustrated in FIGS. 9 and 10, and comprises a bell crank-type hydraulic tensioning device incorporating a conventional hydraulic cylinder 102 having a piston (not shown) which reciprocates in a direction substantially perpendicular to the tie members 32, 33. The cylinder 102 is mounted in a bracket 104 having a bottom plate 106 secured to an outer surface of a buckstay 30 and a pair of spaced sidewalls 108 extending from the edges of plate 106. An aperture 110 through the top of cylinder 102 aligns with a first pair of apertures 112 in the sidewalls 108 of bracket 104 and is secured thereto by retaining pin 114.

The piston of cylinder 102 is actuated by connecting rod 116, the distal end of which is pivotably connected to an end of a tie member 33 through a lever arm 118 having a first end 120 and a second end 122. The first end 120 of lever arm 118 is pivotably connected to the distal end of connecting rod 116, and the second end 122 of lever arm 118 is provided with a collar 124 through which the end of tie member 33 extends and is secured against relative movement by a retaining nut 74. The second end 122 of lever arm 118 is pivotably connected to the side walls 108 of bracket 104 by a pin 126 extending through lever arm 118 and extending into a second pair of apertures 128 in sidewalls 108 of bracket 104. Thus, reciprocal movement of cylinder 42 is translated to inward and outward movement of tie member 33 relative to buckstay 30.

The fluid pressure in tensioning means 40 is regulated by pressure regulation means 67 and control means 101, as described above. Furthermore, it will be appreciated that tensioning means 100 may also include a saddle and a safety nut, similar to that described above.

Figure 11:
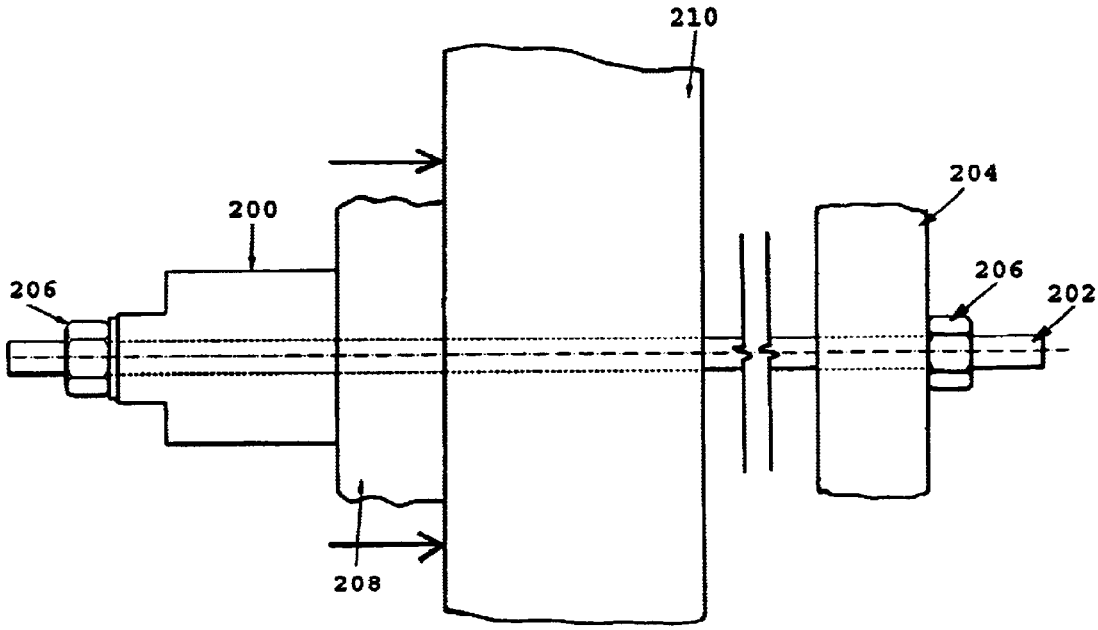
FIG. 11 is a simplified, schematic plan view of a furnace binding system according to a third preferred embodiment of the present invention.
Figure 12:
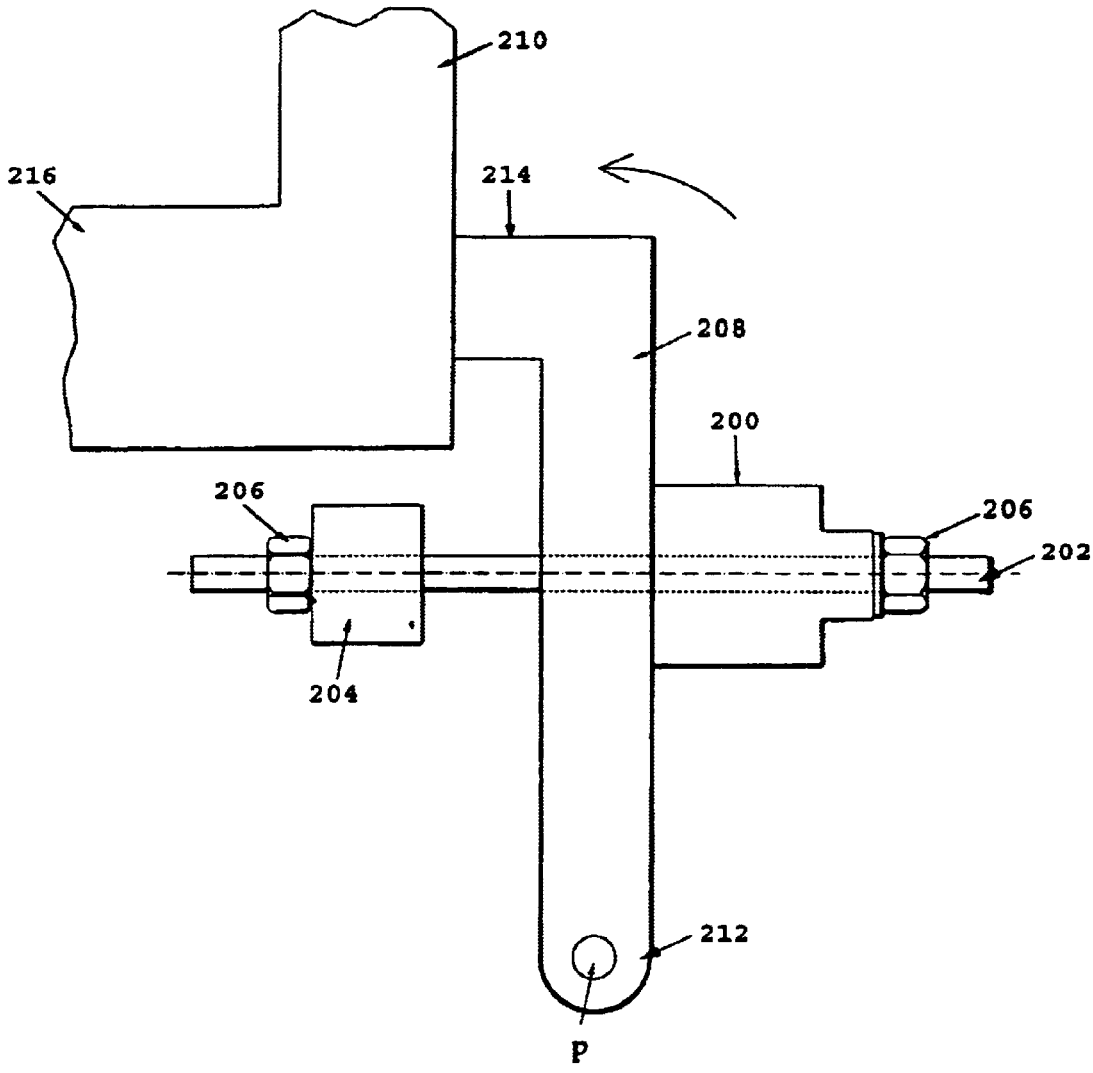
FIG. 12 is a simplified, schematic side view showing one variation of the furnace binding system of FIG. 11.
Figure 13:
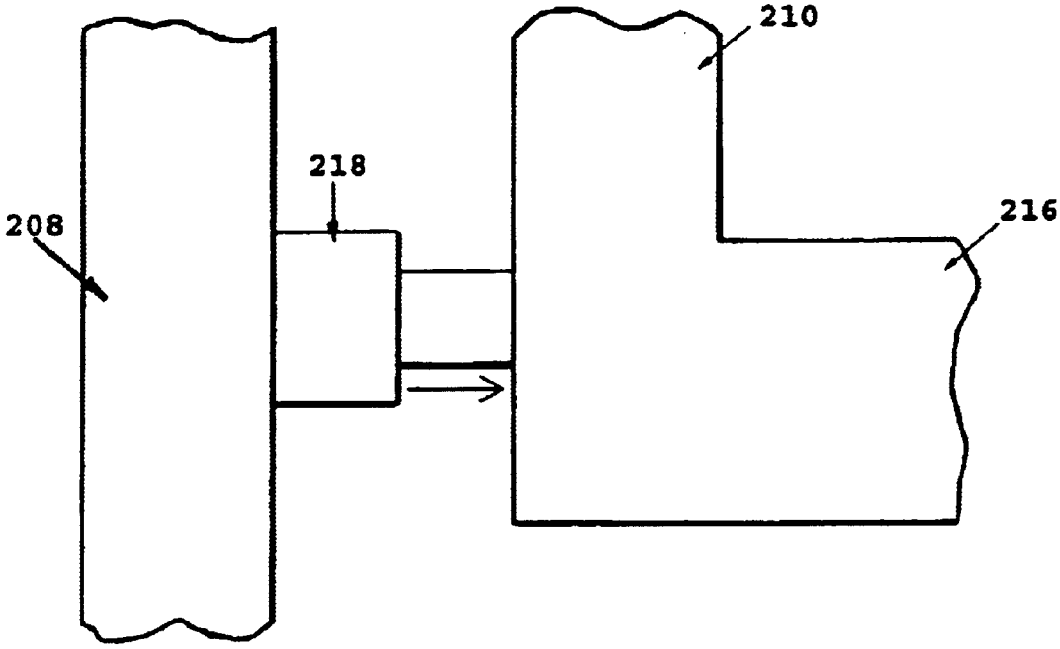
FIG. 13 is a simplified, schematic side view showing a fourth preferred embodiment of the invention in which a fluid-pressurized cylinder directly applies compressive forces to a furnace.

Further preferred aspects of the present invention are now described in connection with FIGS. 11 to 13. FIGS. 11 to 13 are simplified drawings of some of the components of a furnace binding system. In each of these drawings, an arrangement of components is shown for applying compressive forces at one location of a furnace. However, it will be appreciated that a number of such arrangements are preferably provided to form a furnace binding system, and that the binding system is preferably controlled as described above, thereby permitting remote operation and simultaneous application of compressive forces at several points on the furnace.

FIG. 11 illustrates a third preferred embodiment of a furnace binding system in which a fluid-pressurized cylinder 200, which is similar to fluid-pressurized cylinder 42 described above, is used to apply a tensioning force to a tie member 202 extending between cylinder 200 and a retaining member 204. Retaining nuts 206 are received on the opposite ends of tie member 202 to retain the tie member 202 relative to the cylinder 200 and retaining member 204. The cylinder 200 is supported on a support member 208 which applies force on a furnace wall 210 in the direction of the arrows shown in FIG. 11.

The arrangement of components shown in FIG. 11 is similar to that described above with reference to FIGS. 1 to 8, except that the tie member 202 does not extend across the furnace. In one preferred embodiment, the support member 208 may comprise a buckstay and the retaining member 204 comprises a beam or other stationary member located inwardly of the furnace wall 210, and situated either above or below the furnace wall 210. It will be appreciated that the arrangement shown in FIG. 11 could be used to apply horizontal compressive forces to a furnace, thereby compressing the hearth as in the first preferred embodiment. The arrangement shown in FIG. 11 is applicable to furnaces of any shape, including circular and rectangular furnaces.

In the arrangement shown in FIG. 11, it will be appreciated that a fluid-pressurized cylinder having a bell crank mechanism similar to that shown in FIGS. 9 and 10 could be substituted for cylinder 200.

As mentioned above, the support member 208 may comprise a buckstay similar to those shown in FIGS. 1 to 10. However, FIG. 12 illustrates one variant of the binding system shown in FIG. 11 in which the support member 208 has a lower, pivoting end 212 pivotable about point P and an upper end 214 applying a compressive force to furnace wall 210 and hearth 216. The cylinder 200 is located intermediate the lower and upper ends 212 and 214 and applies tension to tie member 202 extending between the cylinder 200 and a stationary retaining member 204.

It will be appreciated that the arrangement illustrated in FIG. 12 is applicable to furnaces of any shape, including circular and rectangular. Furthermore, it will be appreciated that the relative positions of the cylinder 200 and pivot point P could be varied. For example, the pivot point P could be located between the cylinder 200 and the upper end 214 of support member 208, similar to the configuration shown in FIG. 11.

Lastly, FIG. 13 illustrates a simplified arrangement in which the tie member 202 is eliminated and a fluid-pressurized cylinder 218 directly applies compressive force to the furnace sidewall 210 and hearth 216.

Although the invention has been described in connection with certain preferred embodiments, it is not intended to be limited thereto. Rather, the invention includes all embodiments which may fall within the scope of the following claims.

What is claimed is:

1. A furnace binding and adjustment system for a rectangular furnace having a pair of opposed sidewalls, a pair of opposed end walls and a hearth comprised of refractory bricks, said system comprising:

a plurality of vertically extending buckstays arranged in spaced relation along each of the sidewalls and end walls of the furnace, said buckstays each having an inner face engaging one of said walls, an opposed outer face, and a lower end extending below the hearth, said buckstays being arranged in pairs with the buckstays of each said pair being positioned across the furnace from one another;

a plurality of lower tie members, each having a first end and a second end and extending below the hearth between the lower ends of a pair of said buckstays;

a plurality of fluid-pressurized lower tensioning means, each of said lower tensioning means being secured to a lower end of one of said buckstays and being connected to the first end of one of said lower tie members, each said lower tensioning means adjustably controlling an amount of tension in one of said lower tie members to thereby apply a controlled compressive force to the furnace and one or more pressure regulation means for regulating fluid pressure in each of said lower tensioning means, wherein said pressure regulation means simultaneously or individually adjusts the fluid pressure in one or more of the lower tensioning means.

2. The furnace binding and adjustment system of claim 1, wherein at least one of said lower tie members extends between the lower ends of each pair of buckstays, and wherein one of said lower tensioning means is provided at said first end of each lower tie member.

3. The furnace binding and adjustment system of claim 1, wherein the second end of each said lower tie member is secured in relation to one said buckstay by a retaining nut.

4. The furnace binding and adjustment system of claim 1, wherein each of said buckstays also has an upper end extending above the sidewalls and end walls of the furnace, said binding and adjustment system further comprising:

a plurality of upper tie members, each having a first end and a second end and extending between the upper ends of a pair of said buckstays;

a plurality of fluid-pressurized upper tensioning means, each of said upper tensioning means being secured to an upper end of one of said buckstays and being connected to a first end of one of said upper tie members, each said upper tensioning means adjustably controlling an amount of tension in one of said upper tie members to thereby apply a controlled compressive force to the furnace.

5. The furnace binding and adjustment system according to claim 1, wherein said lower tensioning means each include a hydraulic cylinder.

6. The furnace binding and adjustment system according to claim 1, wherein each of said lower tensioning means is secured to an outer face of one of said buckstays, and wherein the first end of each of the tie members passes through an aperture in the lower end of a buckstay for connection to said hydraulic cylinder.

7. The furnace binding and adjustment system according to claim 6, wherein at least one of said hydraulic cylinders has a housing with a bore through which the first end of the tie member passes, and a piston received inside the bore, the piston having an end protruding outwardly from an end of the housing, the first end of the tie member being retained by a retaining nut bearing against the protruding end of the piston.

8. The furnace binding and adjustment system according to claim 5, wherein at least one of said hydraulic cylinders has a piston which moves in a direction substantially perpendicular to said tie members.

9. The furnace binding and adjustment system according to claim 1, further comprising one or more pressure regulation means for regulating fluid pressure in each of said lower tensioning means.

10. The furnace binding and adjustment system according to claim 9, wherein said pressure regulation means simultaneously adjust the fluid pressure in one or more of the lower tensioning means.

11. The furnace binding and adjustment system according to claim 9, wherein said pressure regulation means individually adjust the fluid pressure in the lower tensioning means.

12. A furnace binding and adjustment system for a rectangular furnace having a pair of opposed sidewalls, a pair of opposed end walls and a hearth comprised of refractory bricks, said system comprising:

a plurality of vertically extending buckstays arranged in spaced relation along each of the sidewalls and end walls of the furnace, said buckstays each having an inner face engaging one of said walls, an opposed outer face, and a lower end extending below the hearth, said buckstays being arranged in pairs with the buckstays of each said pair being positioned across the furnace from one another;

a plurality of lower tie members, each having a first end and a second end and extending between the lower ends of a pair of said buckstays; and a plurality of fluid-pressurized lower tensioning means, each of said lower tensioning means being secured to a lower end of one of said buckstays and being connected to the first end of one of said lower tie members, each said lower tensioning means adjustably controlling an amount of tension in one of said lower tie members to thereby apply a controlled compressive force to the furnace;

wherein said lower tensioning means each include a hydraulic cylinder, at least one of said hydraulic cylinders having a piston which moves in a direction substantially perpendicular to said tie members; and wherein said hydraulic cylinder is connected to a first end of one of said lower tie members through a lever having a first end and a second end, said piston being pivotably connected to said first end of the lever and said second end of the lever being connected to said lower tie member end such that movement of the piston of the cylinder causes lateral movement of the lower tie member end relative to the buckstay.

13. A furnace binding and adjustment system for a rectangular furnace having a pair of opposed sidewalls, a pair of opposed end walls and a hearth comprised of refractory bricks, said system comprising:

a plurality of vertically extending buckstays arranged in spaced relation along each of the sidewalls and end walls of the furnace, said buckstays each having an inner face engaging one of said walls, an opposed outer face, and a lower end extending below the hearth, said buckstays being arranged in pairs with the buckstays of each said pair being positioned across the furnace from one another;

a plurality of lower tie members, each having a first end and a second end and extending between the lower ends of a pair of said buckstays;

a plurality of fluid-pressurized lower tensioning means, each of said lower tensioning means being secured to a lower end of one of said buckstays and being connected to the first end of one of said lower tie members, each said lower tensioning means adjustably controlling an amount of tension in one of said lower tie members to thereby apply a controlled compressive force to the furnace; and pressure regulation means for regulating fluid pressure in each of said lower tensioning means, said pressure regulation means comprising a plurality of remotely controlled manifolds controlling the flow of fluid to and from the lower tensioning means.

14. The furnace binding and adjustment system according to claim 13, wherein one of said manifolds is provided for each lower tensioning means and is connected thereto through fluid lines.

15. The furnace binding and adjustment system according to claim 13, wherein said pressure regulation means further comprises a supply of fluid and pumping means for pumping said fluid to said lower tensioning means.

16. The furnace binding and adjustment system according to claim 15, wherein each of said pressure regulation means further comprises a gas over fluid accumulator.

17. The furnace binding and adjustment system according to claim 13, further comprising control means for controlling operation of said pressure regulation means, said control means being remotely located from said furnace.

18. A furnace binding and adjustment system for applying a compressive force to a furnace having a hearth and/or one or more sidewalls comprised of refractory bricks, said system comprising:

(a) fluid-pressurized tensioning means;

(b) a tie member having first and second ends, the first end attached to the tensioning means;

(c) a retaining member to which the second end of the tie member is secured, wherein actuation of the tensioning means increases tension in the tie member between the tensioning means and the retaining member; and (d) a support member for supporting said tensioning means;

wherein said retaining member and said support member are spaced from one another with one or both of said retaining member and said support member being in compressive contact with said furnace; and wherein actuation of the tensioning means to increase tension in the tie member causes a corresponding increase in said compressive force;

wherein the tie member extends horizontally below the furnace, with the support member being in compressive contact with a sidewall of the furnace and extending vertically along a sidewall of the furnace; and wherein the support member has an upper end in compressive contact with a lower portion of a furnace sidewall so as to apply said compressive force to the hearth of the furnace, and wherein said support member is pivotable about a pivot point such that increasing tension in the tie member causes an increase in the compressive force applied by the upper end of the support member.

19. The furnace binding and adjustment system according to claim 18, wherein the pivot point is located proximate the lower end of the support member.

* * * * *

UNITED STATES PATENT AND TRADEMARK OFFICE

CERTIFICATE OF CORRECTION

PATENT NO. : 6,814,012 B2 
DATED : November 9, 2004
INVENTOR(S) : Felim P. McCaffrey et al.

It is certified that error appears in the above-identified patent and that said Letters Patent is hereby corrected as shown below:

Title page,
Item [73], Assignee, after "Assignee:" please delete "Hatch Associates Ltd." and insert -- Hatch Ltd. -- in its place.

Signed and Sealed this

Twenty-fourth Day of May, 2005

JON W. DUDAS
*Director of the United States Patent and Trademark Office*